United States Patent [19]

Pohlus

[11] Patent Number: 4,889,509

[45] Date of Patent: Dec. 26, 1989

[54] SLIDEABLE OUTRIGGER

[76] Inventor: Günther Pohlus, Klosterwag 26, D-8137 Berg 3, Fed. Rep. of Germany

[21] Appl. No.: 241,816

[22] Filed: Sep. 2, 1988

Related U.S. Application Data

[63] Continuation of Ser. No. 2,667, Dec. 12, 1986, abandoned.

[30] Foreign Application Priority Data

Apr. 19, 1985 [DE] Fed. Rep. of Germany ..... 3514105
Apr. 23, 1985 [DE] Fed. Rep. of Germany ..... 3514566

[51] Int. Cl.[4] ..... B63H 16/067
[52] U.S. Cl. ..... 440/105; 440/106; 114/363; 272/72
[58] Field of Search ..... 440/104–110; 114/347, 363; 272/72; 280/224, 225

[56] References Cited

U.S. PATENT DOCUMENTS

| | | | |
|---|---|---|---|
| 182,023 | 8/1876 | Isaacs, Jr. | 114/363 X |
| 184,031 | 11/1876 | Blakeman, Jr. | 114/363 X |
| 209,960 | 11/1878 | Davis | 114/363 X |
| 230,690 | 8/1880 | Bennett | 114/363 X |
| 4,052,951 | 10/1977 | Farr | 440/105 |
| 4,383,830 | 5/1983 | Cartwright | 440/105 X |
| 4,623,318 | 11/1986 | Waugh | 440/105 X |

FOREIGN PATENT DOCUMENTS

| | | | |
|---|---|---|---|
| 2216545 | 10/1973 | Fed. Rep. of Germany | 440/106 |
| 301857 | 11/1981 | Fed. Rep. of Germany | 440/105 |
| 861 | of 1885 | United Kingdom | 440/106 |
| 607158 | 8/1948 | United Kingdom | 114/363 |
| 2099773 | 12/1982 | United Kingdom | 114/347 |

OTHER PUBLICATIONS

V. Nolte, "Die Geschichte des Rollauslegerbootes", Rudersport, 26/81, pp. 526–527.
V. Nolte, "Uber die Wissenschaft beim Rollausleger", Rudersport, 30/81, pp. 639–642.

*Primary Examiner*—Joseph F. Peters, Jr.
*Assistant Examiner*—Paul E. Salmon
*Attorney, Agent, or Firm*—Nils H. Ljungman

[57] ABSTRACT

On a rowboat with fixed installed rowing seats (4) and outriggers which can move in relation to them in the longitudinal direction of the boat, the outriggers are designed as slideable outriggers (1) which can slide on a single linear guide (11) like sleds, without tipping, forward or backward. In one particular configuration, there are connection devices (17, 18) located between the outboard segments of the sliding outriggers (1). These connection devices can also be located inside the hull of the boat. The linear guidance mechanism (11) consists essentially of a shaft (12) running parallel to the longitudinal axis of the boat inside or outside the hull of the boat (11*a*). One or more suspension elements (13) connected with one or more sliding outriggers (1) are guided in a sliding or rolling manner on this shaft (12).

21 Claims, 3 Drawing Sheets

SLIDEABLE OUTRIGGER

This application is a continuation of U.S. application Ser. No. 002,667, filed on Dec. 12, 1986, abandoned.

BACKGROUND OF THE INVENTION

1. Field of the Invention:

The invention relates to a rowboat with a fixed rowing seat (or seats), and an outrigger (or outriggers) which move in relation to it in the longitudinal direction of the boat, with a stretcher or stretchers coupled to move rigidly with it.

2. Description of the Prior art:

Rolling outriggers of the prior art (see V. Nolte, "Rudersport" 26/81, pp. 526–527, and "Rudersport" 30/81, pp. 639–642) are characterized by the fact that they are provided individually for each rowing position. This poses the problem for the oarsmen especially when he is a member of a crew, that it takes rather a long time to become accustomed to the proper sequence of movements and, especially, to the pace of the crew.

On outriggers of the prior art, two rollers are always guided in two rollers tracks extending along the walls of the boat. As a result of irregularities in rowing, particularly with unpracticed oarsmen, these rollers can easily tip in their tracks and are thereby unable to roll. On account of this tendency to tip, rolling outriggers of the prior art are not suitable for use in boats where each oarsman pulls one oar with both hands.

An additional disadvantage of rolling outriggers of the prior art consists in the fact that they must be adjusted to fit oarsmen of different sizes.

OBJECT OF THE INVENTION

The object of the invention, therefore, is to design a rowboat of the type described above so that it can be used reliably and easily for rowing all types of rowboats, including multiple-hulled boats.

SUMMARY OF THE INVENTION

This object is achieved by means of the characteristics described in claim 1. As described herein, the linear longitudinal movement of the outrigger is guided precisely by a single guide, for example, a rail, by means of elements guided by ball bearings or friction bearings. Since the principle applied here relates to a linearly guided sled, in which the lateral play of the longitudinal guide mechanism is minimized, the invention largely eliminates the danger of tipping. By itself, this characteristic encourages the individual oarsman to perform with more uniform motion.

In another embodiment, two individual slideable outriggers, or even one or more groups of slideable outriggers, can be coupled with one another on a boat so that they move together. The connection apparatus which provides the coupling movement can be designed so that it released easily. On account of the coupling movement, the adjustment of the individual oarsman to the rhythm of the team becomes significantly easier. The connection apparatus can thereby be located either between outboard segments of the slideable outrigger and/or inside the hull of the boat. Both variants achieve the advantage that the oarsmen can easily adjust their couplings in relation to one another to suit changing circumstances.

Particularly on multi-hulled boats, but also on rowboats with two rows of rowing positions, it may be appropriate to couple the slideable outriggers of several rows with one another, or even of groups of positions in different rows with one another. The linear guidance is appropriately realized in the form of a shaft or rail running parallel to the longitudinal axis of the boat, and located inside or outside the hull of the boat. Suspension elements designed as rolling and/or sliding elements are thereby guided along the rail, and the outriggers are attached to or suspended from these suspension elements. Instead of with closed bearings, ball-type bearings or friction bearings, the linear guidance system can also be furnished with roller bearings. The latter are located in a cage surrounding the rail profile of the linear guidance system, so that they can adsorb all horizontal and vertical forces which are exerted via the outrigger on the cage and the rail guidance profile. Play in the guidance system and friction losses are thereby largely prevented.

For proper rowing operation, it is necessary that the outrigger movements always be executed in an essentially horizontal plane. According to another configuration, this is achieved with a simultaneous reduction of the load and simplification of the linear guidance system, as a result of the fact that the support rollers attached to the outrigger are held so that they can move back and forth in the guide rails which run horizontally. On the other hand, it is also possible that the function of the horizontal mounting of the sliding outrigger can also be combined with the linear guide system or the stretcher. The latter is appropriately equipped with rollers, whose movement is guided in corresponding rails.

For adjustment to the movement of the oarsman, in another embodiment, the stretcher is designed so that it can be folded and/or pivoted around an axis transverse to the longitudinal axis of the boat. Specifically, according to the invention, the feet of the oarsmen can be clamped, for example, by foot clamps, to pivoting plates which are the size of shoes, so that the oarsmen can take advantage of the pivoting motion around the balls of his feet, pulling in his knees and raising his heels, without placing particular loads on the feet, oars or outrigger. When the legs are fully extended, the heels once again make prompt contact with a solid support (heelrest), so that the oarsmen's knees do not sag during the stroke.

For the easier relaxation of the oarsman there can also be provided for use with the coupled slideable outrigger, a pre-stressed spring element, for example, an elastic band or a steel spiral spring. which will allow the outrigger to be pulled into the starting position To capture the outrigger at the end of the leg kick, and to make possible a smooth deceleration, the excursion of the elastic retaining band is overcome by the force of an additional, harder spring.

According to another characteristic of the invention, the oar seat and/or the stretcher can be moved and adjusted so that each oarsman can fully extend his legs. If, for example, the rowing seat is moved along the longitudinal axis of the boat by a determined distance from the normal position, then it is advantageous if, as suggested by the invention, the oarlock on the outrigger can be moved parallel by the same distance. For this purpose, in a refinement of the invention, there is a guide rail on the outrigger so that the oarlock can be moved in it by a maximum distance corresponding to the difference in the length of the legs of the tallest and the shortest oarsman. By means of tightening and locking levers in the vicinity of the oarlock, such an adjustment can easily be made from the rowing position.

To facilitate the attachment and transport, the outriggers, according to the invention, which stretcher and/or linear guidance mechanism, are designed so that they can be easily removed from the boat. In addition, the outrigger can be equipped with joints, for example, hinges, so that it can be folded up.

Specifically on a larger rowboat, such as an eight-oared rowing shell, and when there are extreme differences in height between oarsmen on a team, the invention makes it possible to couple the outriggers for the shorter oarsmen together, and separately, the outriggers for the taller oarsmen with one another. To individually adjust the ratios of inside to outside levers on the oars, there is an oarlock ring with several stages (multiple oarlock ring) on the oar, by means of which the lever ratio can be adjusted so that the shortest oarsmen cover approximately the same stroke over the water as the taller oarsmen, without need to use additional force.

On account of the preferably flat connection of the individual outriggers, all the lateral compression and tensile forces are directed toward one another, so that they largely offset one another. The loads on the bearings and, thus, the stresses on the flexural strength of the profile of the linear guidance system are thereby reduced, so that the outrigger guidance system can be made lighter and cheaper. The use of outriggers coupled to one another in multi-oared racing shells requires fewer ball and roller bearings, which would otherwise have to be installed at each rowing position to achieve a low-friction compensation for the forces interfering with the linear motion.

On a large racing shell, by connecting the individual outrigger surfaces into a single, rigid, overall outrigger surface, it would theoretically be possible to achieve the same minimum bearing requirements as for a single outrigger, which would result in multiple savings. In practice, however, a large outrigger surface of several square meters cannot be reinforced without producing additional disadvantages. Therefore, an additional support bearing installation is more reasonable.

Since the lightweight construction desired for racing shells is also accompanied by certain bowings and torsional weaknesses in the hull of the boat, the precise linear guidance of a single overall outrigger, for example, 6 meters long, cannot be achieved in a manner appropriate to the characteristics of the bearings, for example, for ball bearings, and the straight-line characteristics which would be required.

Since the overall longitudinal displacement of the total outrigger, however, is a maximum of only approximately 60 cm, when ball bearings are used, for example, with integrated compensation for alignment errors, it is not possible, without additional measures, to maintain the specified straightness tolerance between the bearings at the two opposite ends (in the example, approximately 6 m–60 cm). In the area between the two total outrigger end bearings, depending on the characteristics of the outrigger and the boat, either additional linear guidance mechanisms must be omitted, and instead only simple supporting rollers used, or additional intermediate linear bearings. If ball bearings are used on a shaft or aligning shaft pieces, these bearings must be correspondingly flexibly supported, for example, in rubber. The "floating" of the bearings must compensate for static stresses, and must make certain that the load on the bearing does not exceed the allowable values; however, it cannot lead to a condition where the overall outrigger begins to "float".

The claims and the following description indicate additional configurations and advantages of the invention with reference to the drawings.

DESCRIPTION OF THE PREFERRED EMBODIMENTS

Figure 1:
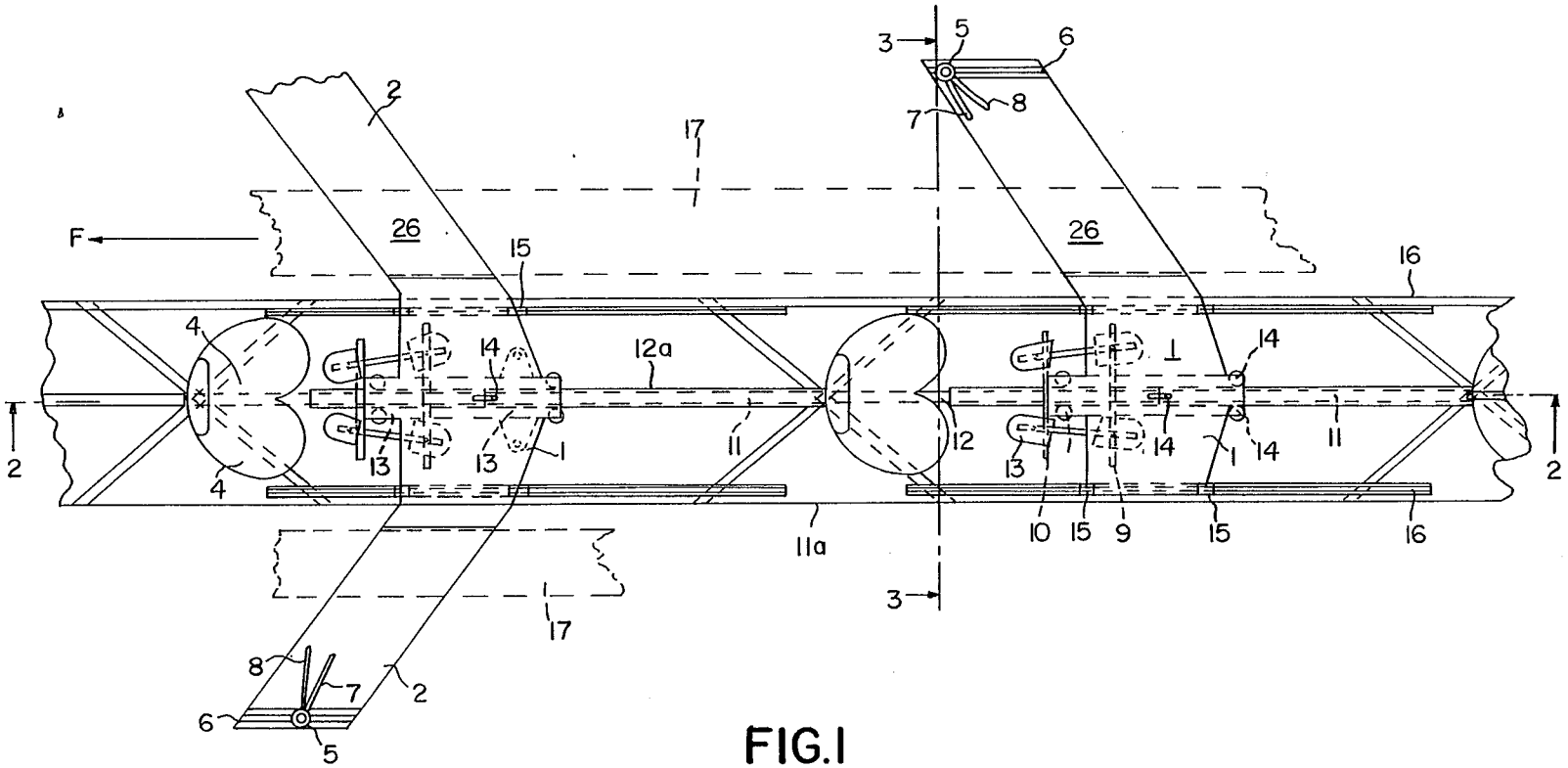
FIG. 1 shows an overhead view of a rowboat according to the invention.

As shown in FIG. 1, the rowboat according to the invention, includes a movable sliding outrigger 1 with outboard lateral surfaces 2, and stretchers 3 always rigidly connected with the sliding outriggers 1. In addition, there is a rowing seat 4, the position of which can be adjusted, and which during rowing remains in a fixed position in relation to the hull 11*a* of the boat. The rear sliding outrigger, seen in the direction of travel F, is designed as a double outrigger with two lateral surfaces 2 on each side of the boat, which makes it possible to scull instead of rowing with both hands on one oar. In addition, the lateral surfaces 2 are provided with oarlocks 5 on their edges parallel to the direction of travel, which are held so that they can move in guide rails 6. In addition to the guide rails 6, to position the oarlocks 5 in the longitudinal direction of the boat, there is a tightening lever 7 and a corresponding locking lever 8. These two levers are appropriately designed so that the oarsmen can comfortably adjust them from the rowing seats 4. The stretchers 3 can be pivoted or folded around a rod 9 to facilitate movement during rowing.

The stretchers 3 also include another rod 10, which serves as a support for the oarsmen's heels.

In the embodiment illustrated in FIG. 1, there is a linear guidance system 11 inside the hull 11a of the boat, which essentially consists of an inner, continuous shaft 12, which is surrounded at intervals by steel jackets or steel sleeves 12*a*, as well as, cage-like suspension elements 13, in which rollers 14, rolling on the steel sleeves 12*a*, are enclosed. Preferably, the inner shaft 12 is made of plastic, for example, glass-fiber reinforced plastic, and the sleeves or jackets are made of steel, metal, etc. Inner shafts designed in this manner as the core of the linear guidance system 11 provide an elastic compensation for static stresses between the outrigger 1 and the hull 11*a* of the boat, while the largely deformation-proof metal sleeves or jackets 12a guarantee a precise longitudinal guidance of the sliding outriggers 1. The rollers 14 are mounted in the suspension element 13 so that there is no play.

There are also other rollers 15 mounted on the sliding outriggers 1, and these rollers run in horizontal guide rails 16, which are always located in the peripheral area of the hull 11*a* of the boat extending in the longitudinal direction. The horizontal guide rails 16 are designed and oriented so that they prevent the rollers 15 from leaving the corresponding horizontal plane.

The coupling of the movements of two or more sliding outriggers 1 can be realized in the present example by means of a flat connection apparatus 17. It can be removed and replaced as required by means of attachment elements 26, indicated by dotted lines.

The suspension elements 13 are attached to the outrigger or outriggers 1 by means of an elastic mounting in a "floating" manner.

Figure 2:
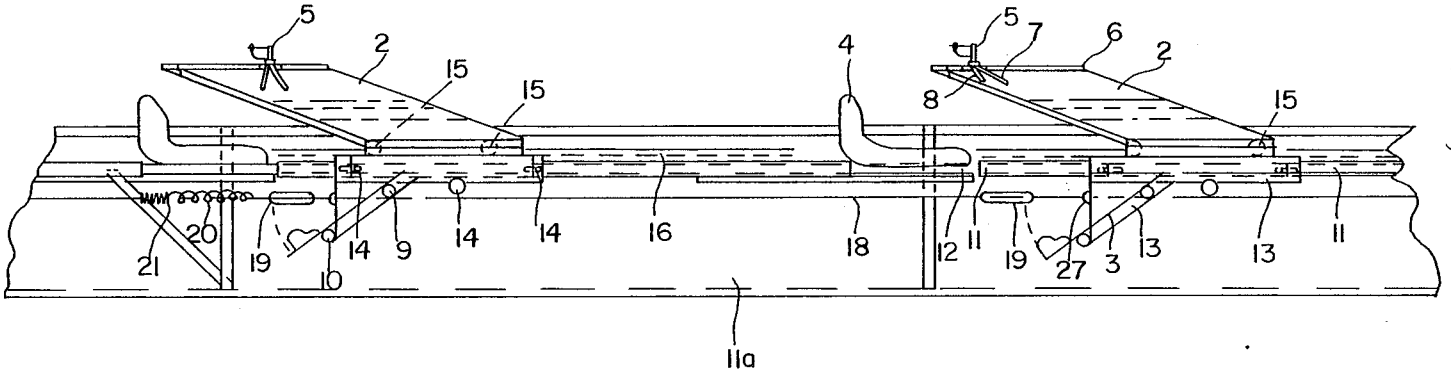
FIG. 2 shows a cross section along Line II—II in FIG. 1.

FIG. 2 shows a rigid rod 18 connected to move together with the outriggers 1 by means of spot welds 27, for example. An interlock 19, which interrupts the rod 18 at the level of each sliding outrigger, allows the individual sliding outriggers 1 to be uncoupled so that they move independently or together, as required. The rod 18, therefore, represents another possibility for the coupling of individual sliding outriggers 1, or all of them, with one another.

To encourage the relaxation of the oarsman while pulling in his legs into the starting position, the interposition of a soft spring 20 in the rigid rod 18 is appropriate: it encourages the movement of the oarsman into the starting position, thereby stabilizing his rowing rhythm, and can, therefore, encourage harmony during team rowing. When the legs of the oarsmen are sliding into the retracted position, the soft spring 20 is extended and stressed. To guarantee an impact-free braking for the sliding outrigger 1 shortly before the limit retracted position is reached, another hard spring 21 is connected in series with the soft spring 20, as shown in the embodiment, whereby only when the limit retracted position is reached, is it extended by a superimposed steel filament (not shown).

Figure 3:
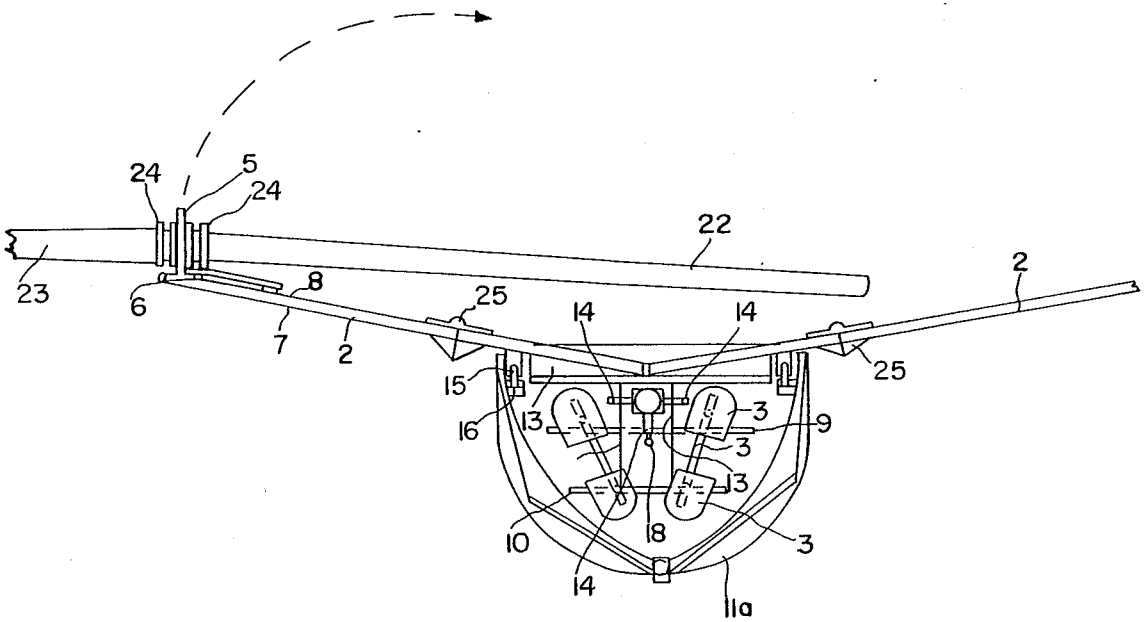
FIG. 3 shows a cross section along Line III—III in FIG. 2.

As shown in FIG. 3, the oar can be adjusted to the physical characteristics of the oarsman, because the length ratio of the inner lever 22 of the oar can be varied in relation to the outer lever 23 by means of multi-stage oarlock ring 24 which surrounds the oar grip. To facilitate transport and attachment, finally, there is a folding element 25 designed as a hinge with a bracket. The corresponding folding movement is indicated by the round arrow in FIG. 3.

What is claimed is:

1. A rowboat with a hull and at least one fixed rowing seat, and at least one outrigger which slides in relation to its corresponding rowing seat disposed in the longitudinal direction of the boat, each outrigger having a stretcher affixed thereto and for moving therewith, the at least one outrigger being slideably mounted for sliding forward or backward like a sled on linear guide means, said linear guide means comprising a single central linear guide being substantially fixed to said hull;

said linear guide means comprising two sets of restraining means affixed to said at least one outrigger spaced lengthwise at a substantial distance apart along said central guide to minimize tipping of the at least one outrigger during backward and forward movement of said at least one outrigger.

2. The rowboat according to claim 1, wherein said at least one outrigger comprises:

at least two sliding outriggers, a connection apparatus for coupling said at least two outriggers with one another so that the outriggers move together during rowing by means of said connection apparatus.

3. The rowboat according to claim 2, wherein the connection apparatus is located between outboard segments of said at least one sliding outrigger outside the hull of the boat.

4. The rowboat according to claim 3, wherein the linear guide comprises a rail means running parallel to the longitudinal direction of the boat adjacent the hull of the coat, on which at least one suspension element connected with said at least one sliding outrigger is slideably guided.

5. The rowboat according to claim 4, wherein guide elements are attached to the sliding outriggers for their horizontal support, which are mounted so that they can only move in the horizontal direction.

6. The rowboat according to claim 5, wherein the linear guide also includes the function of the horizontal support of the sliding outriggers.

7. The rowboat according to claim 6, wherein said at least one sliding outrigger has a starting position and a limit position;

said at least one sliding outrigger having a resilient return means connected to said at least one sliding outrigger, said return means being for returning said at least one sliding outrigger to the starting position;

a spring apparatus, said spring apparatus being connected to provide, as the limit position is reached by the sliding outrigger, a force;

the force of said spring apparatus being for countering the force of the resilient return means, said spring apparatus being for providing a stronger force than that of the resilient return means.

8. The rowboat according to claim 7, including means for adjusting the distances between the rowing seat and the stretcher at the starting position of the at least one sliding outrigger, and means for positioning the oarlock on the sliding outrigger.

9. The rowboat according to claim 8, including an oarlock and at least one oar having an inner lever portion for being positioned inboard of said oarlock and an outer lever portion for being positioned outboard of said oarlock, the ratio of the inner lever portion of the oar to its outer lever portion being variable.

10. The rowboat according to claim 4, wherein said rail means is chosen from the group consisting essentially of a shaft and a rail, said rail means comprising plastic, and being surrounded at intervals by firmly attached steel sleeves, said suspension elements equipped with rollers being able to move back and forth on said rail means.

11. The rowboat according to claim 10, wherein the stretcher can be folded and/or pivoted around an axis transverse to the longitudinal axis of the boat.

12. The rowboat according to claim 11, wherein the stretcher also performs the function of providing horizontal support to the at least one sliding outrigger.

13. The rowboat according to claim 12, wherein the at least one sliding outrigger with stretchers are designed so that they can be rapidly installed and removed, whereby outrigger surfaces are designed so that they can fold by means of joint elements.

14. The rowboat according to claim 13, comprising a member of the group consisting essentially of ball bearings, bushings, roller bearings, friction bearings and combinations of the other members of this group are provided for linear and horizontal guidance.

15. The rowboat according to claim 1, wherein the linear guide comprises a rail means running parallel to the longitudinal direction of the boat adjacent the hull of the boat, on which at least one suspension element connected with said at least one sliding outrigger is slideably guided.

16. The rowboat according to claim 1, wherein guide elements are attached to the at least one sliding outrigger for their horizontal support, which are mounted so that they can only move in the horizontal direction.

17. The rowboat according to claim 1, wherein in the starting position of the at least one sliding outrigger, the distances between the rowing seat and the stretcher are adjustable, and that corresponding to this adjustment, the oarlock is attached so that it can be moved on the sliding outrigger.

18. The rowboat according to claim 1, wherein said at least one sliding outrigger has a starting position and a limit position;

said at least one sliding outrigger having a resilient return means connected to said at least one sliding outrigger, said return means being for returning said at least one sliding outrigger to the starting position;

a spring apparatus, said spring apparatus being connected to provide, as the limit position is reached by the sliding outrigger, a force;

the force of said spring apparatus being for countering the force of the resilient return means, said spring apparatus being for providing a stronger force than that of the resilient return means.

19. A rowboat having a hull with a longitudinal direction extending along the length thereof, said rowboat comprising:

at least one fixed rowing seat;

at least one outrigger for sliding in relation to its corresponding rowing seat in the longitudinal direction of the boat;

at least one stretcher being disposed to move with its corresponding outrigger; and linear guide means for said at least one outrigger;

said linear guide means comprising a single, centrally disposed, linear guide, said linear guide means comprising two sets of restraining means affixed to said at least one outrigger spaced lengthwise at a substantial distance apart along said central guide to minimize tipping of the at least one outrigger during backward and forward movement of said at least one outrigger.

20. A rowboat with a hull and at least one fixed rowing seat, and at least one outrigger which slides in relation to its corresponding rowing seat disposed in the longitudinal direction of the boat, each outrigger having a stretcher affixed thereto and for moving therewith, the at least one outrigger being slideably mounted for sliding forward or backward like a sled on linear guide means being fixed to said hull;

said linear guide means comprising at least two sets of restraining means, each of said at least two sets of restraining means being affixed to its corresponding one of said at least one outrigger; and each of said at least two sets of restraining means being affixed to its corresponding one of said at least one outrigger being spaced apart one from the other lengthwise at a substantial distance apart along said guide means to minimize tipping of the at least one outrigger during backward and forward movement of said at least one outrigger.

21. The rowboat according to claim 20, wherein said linear guide means comprises a linear element being disposed in the longitudinal direction of the boat.

* * * * *